US009814363B2

(12) United States Patent
Ha et al.

(10) Patent No.: US 9,814,363 B2
(45) Date of Patent: Nov. 14, 2017

(54) VACUUM CLEANER HAVING A PRESSING MEMBER AND A DUST COLLECTION BODY WITH FOREIGN MATTER CONTROL

(71) Applicant: LG ELECTRONICS INC., Seoul (KR)

(72) Inventors: Gun Ho Ha, Changwon-si (KR); Ji Hoon Kim, Changwon-si (KR); Seung Heun Lim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 663 days.

(21) Appl. No.: 14/494,711

(22) Filed: Sep. 24, 2014

(65) Prior Publication Data

US 2015/0007410 A1 Jan. 8, 2015

Related U.S. Application Data

(62) Division of application No. 13/375,578, filed as application No. PCT/KR2009/004714 on Aug. 24, 2009, now Pat. No. 8,955,193.

(51) Int. Cl.
*A47L 9/10* (2006.01)
*A47L 9/16* (2006.01)

(52) U.S. Cl.
CPC ..... *A47L 9/1683* (2013.01); *A47L 9/108* (2013.01); *Y10S 55/03* (2013.01)

(58) Field of Classification Search
CPC ..... A47L 9/108; A47L 9/1683; F16B 17/00; Y10S 55/03
USPC ..... 464/170, 177, 182; 403/384; 100/223, 100/292, 907, 239
See application file for complete search history.

(56) References Cited

U.S. PATENT DOCUMENTS 6,735,816 B2 * 5/2004 Oh ..... A47L 5/28 15/352
7,237,480 B2 * 7/2007 Ruddock ..... B65F 1/1405 100/226
2008/0263811 A1 10/2008 Sharabura et al. ..... 15/250.48
(Continued)

FOREIGN PATENT DOCUMENTS

EP 1 825 797 A2 8/2007
FR 2 823 091 A1 10/2002
(Continued)

OTHER PUBLICATIONS

International Search Report dated May 19, 2010 issued in PCT Application No. PCT/KR2009/004714.
(Continued)

*Primary Examiner* — Joseph J Hail
*Assistant Examiner* — Arman Milanian
(74) *Attorney, Agent, or Firm* — KED & Associates, LLP

(57) ABSTRACT

Provided is a vacuum cleaner. The vacuum cleaner includes a cleaner main body and a dust container communicating with the cleaner main body, the dust container storing dusts separated from air. The dust container includes a dust collection body including a dust storage part for storing the dusts, a pressing member for compressing the dusts stored in the dust collection body, and a cleaning member contacting an inner surface of the dust collection body to clean the inner surface of the dust collection body.

9 Claims, 16 Drawing Sheets

(56) References Cited

U.S. PATENT DOCUMENTS

| | | | | |
|---|---|---|---|---|
| 2008/0263815 | A1* | 10/2008 | Oh | A47L 9/108 15/347 |
| 2008/0264007 | A1* | 10/2008 | Oh | A47L 9/108 55/304 |
| 2008/0264016 | A1* | 10/2008 | Oh | A47L 5/28 55/429 |
| 2009/0241286 | A1* | 10/2009 | Hwang | A47L 5/365 15/347 |
| 2009/0293223 | A1* | 12/2009 | Hwang | A47L 5/365 15/352 |
| 2010/0212105 | A1* | 8/2010 | Ha | A47L 9/1691 15/347 |
| 2010/0229332 | A1* | 9/2010 | Kang | A47L 9/108 15/347 |
| 2011/0000047 | A1* | 1/2011 | Ji | A47L 9/108 15/347 |

FOREIGN PATENT DOCUMENTS

| | | | |
|---|---|---|---|
| KR | 10-0413988 | B1 | 1/2004 |
| KR | 10-2007-0112325 | A | 11/2007 |
| KR | 10-2008-0069751 | A | 7/2008 |
| KR | 10-0871483 | B1 | 12/2008 |
| KR | 10-0871498 | B1 | 12/2008 |

OTHER PUBLICATIONS

European Search Report dated Dec. 12, 2012 issued in Application No. 09 84 8776.

Korean Notice of Allowance dated Nov. 27, 2013 issued in Application No. 10-2011-7030912.

U.S. Office Action dated Dec. 11, 2013 issued in U.S. Appl. No. 13/375,578.

U.S. Final Office Action dated Jun. 19, 2014 issued in U.S. Appl. No. 13/375,578.

* cited by examiner

VACUUM CLEANER HAVING A PRESSING MEMBER AND A DUST COLLECTION BODY WITH FOREIGN MATTER CONTROL

CROSS-REFERENCE TO RELATED PATENT APPLICTIONS

This application is a Divisional Application of prior U.S. patent application Ser. No. 13/375,578, which is a U.S. National Stage Application under 35 U.S.C. §371 of PCT Application No. PCT/KR2009/004714, filed Aug. 24, 2009, whose entire disclosures are hereby incorporated by reference.

BACKGROUND

1. Technical Field

Embodiments relate to a vacuum cleaner.

2. Background Art

In general, a vacuum cleaner is a device that sucks air containing dusts using a suction force generated by a suction motor mounted in a cleaner main body to filter the dusts in a dust separation device.

The vacuum cleaner includes a suction nozzle for sucking air containing dusts, a cleaner main body communicating with the suction nozzle, a driving source disposed in the cleaner main body to generate an air suction force, a dust separation device in which air is introduced from the cleaner main body to separate the dusts, and a dust container in which the dusts separated in the dust separation device is stored.

Also, the dust container includes a dust collection body in which a dust storage part for storing the separated dusts is defined. The dusts separated in the dust separation device are stored within the dust collection body. Also, when an operation of the vacuum cleaner is stopped while the dusts are introduced into the dust collection body and stored, the separated dusts may be stored in the dust storage part at low density.

In the dust container according to a related art, the dusts stored in the dust storage part occupy a significantly large volume with respect to its weight. Thus, it is inconvenient in that the dust container in which the dusts are stored should be frequently emptied out to maintain dust collection performance.

DISCLOSURE OF THE INVENTION

Technical Problem

Embodiments provide a vacuum cleaner in which dust collection capacity of a dust container is increased.

Embodiments also provide a vacuum cleaner in which dusts stored in a dust collection body are compressed and an inner wall of the dust collection body is cleaned.

Embodiments also provide a vacuum cleaner in which it prevents foreign materials from being caught between a pressing member and a dust collection body.

Technical Solution

In one embodiment, a vacuum cleaner includes: a cleaner main body; and a dust container communicating with the cleaner main body, the dust container storing dusts separated from air, wherein the dust container includes: a dust collection body including a dust storage part for storing the dusts; a pressing member for compressing the dusts stored in the dust collection body; and a cleaning member contacting an inner surface of the dust collection body to clean the inner surface of the dust collection body.

Advantageous Effects

According to the proposed embodiment, since the dusts stored in the dust container are compressed to minimize their volume, the dusts stored in the dust container may be maximized in capacity.

Also, since the cleaning member is slid along the inner surface of the dust container when the pressing member is rotated, the inner wall of the duct container may be cleaned.

Also, as the inner wall of the dust container is cleaned, the dusts accumulated in the duct container may be easily confirmed from the outside.

Also, since the rotation shaft of the pressing member surrounds the fixed shaft disposed on the dust container, it may prevent the foreign materials from being wound around the fixed shaft.

DETAILED DESCRIPTION

Best Mode for Carrying out the Invention

Hereinafter, exemplary embodiments will be described with reference to the accompanying drawings.

Figure 1:
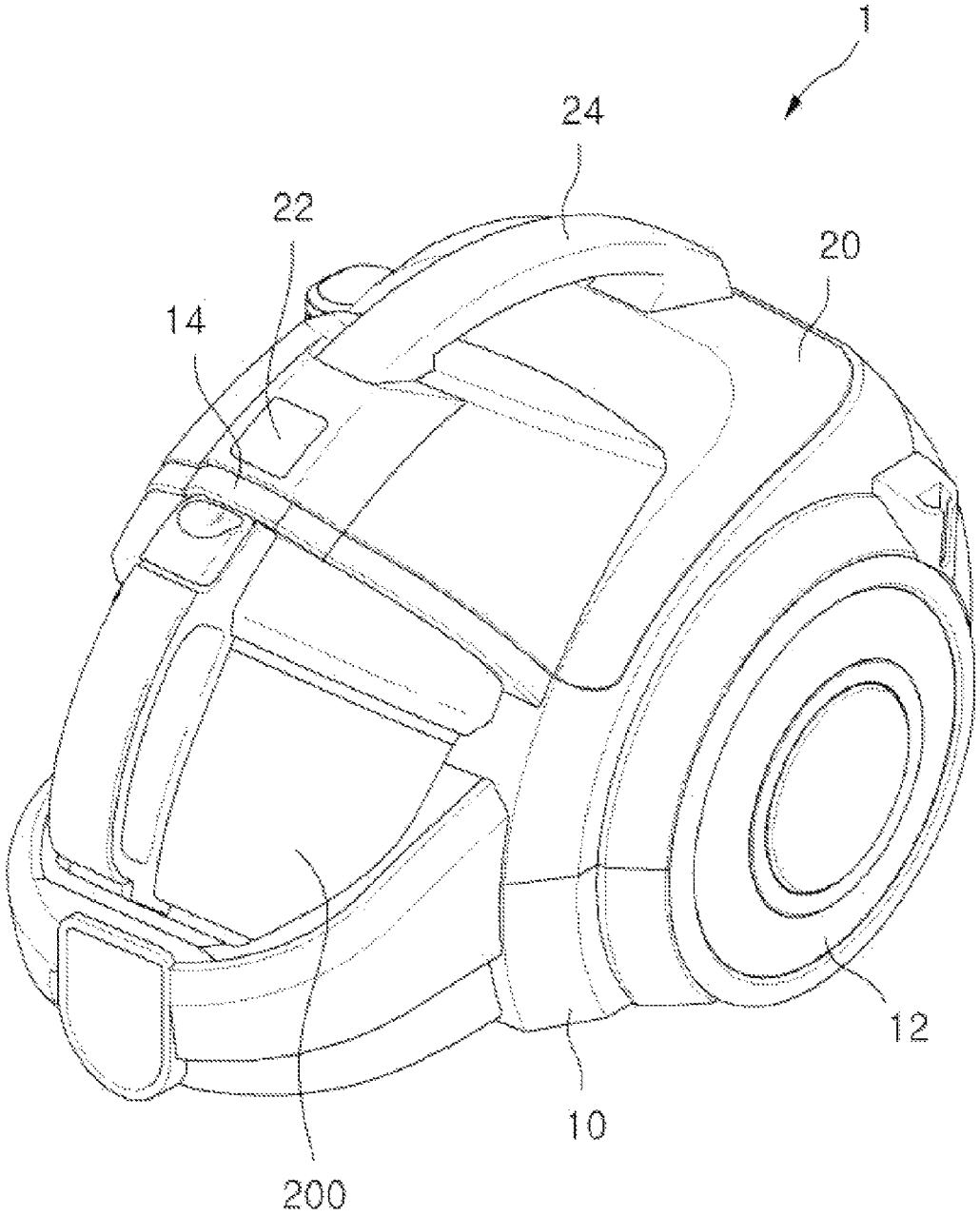
FIG. 1 is a perspective view of a vacuum cleaner including a dust separation device according to a first embodiment.

FIG. 1 is a perspective view of a vacuum cleaner including a dust separation device according to a first embodiment.

Figure 2:
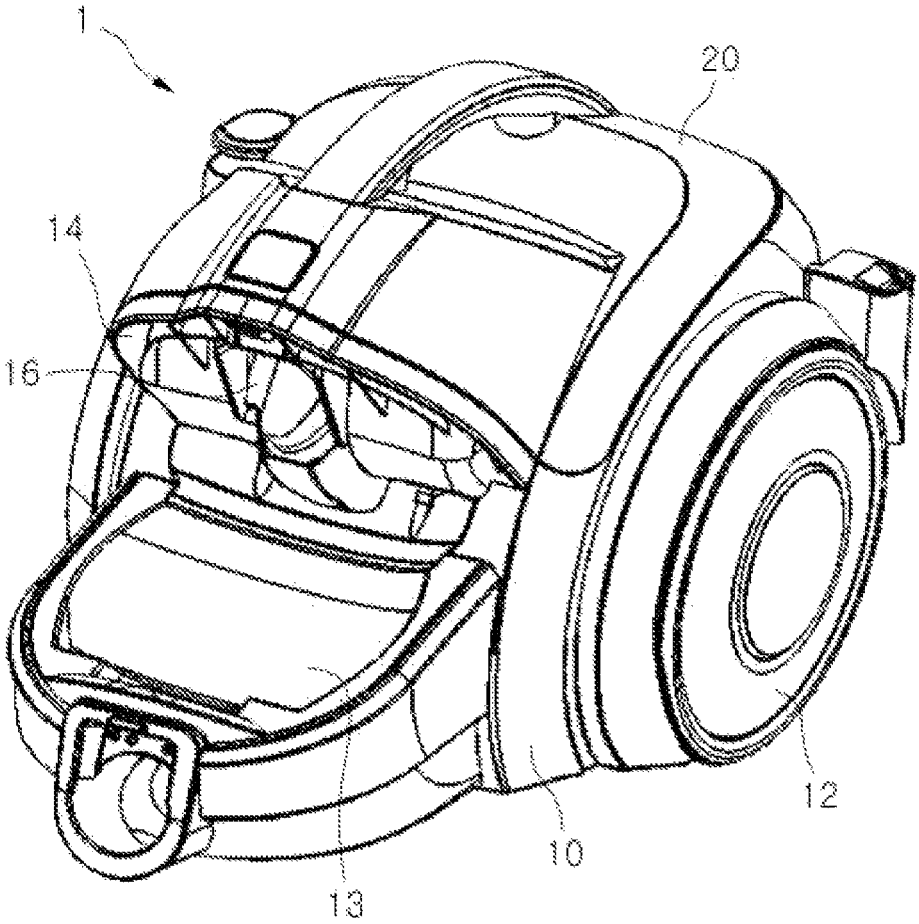
FIG. 2 is a perspective view of the vacuum cleaner from which a dust container is separated according to the first embodiment.
Figure 3:
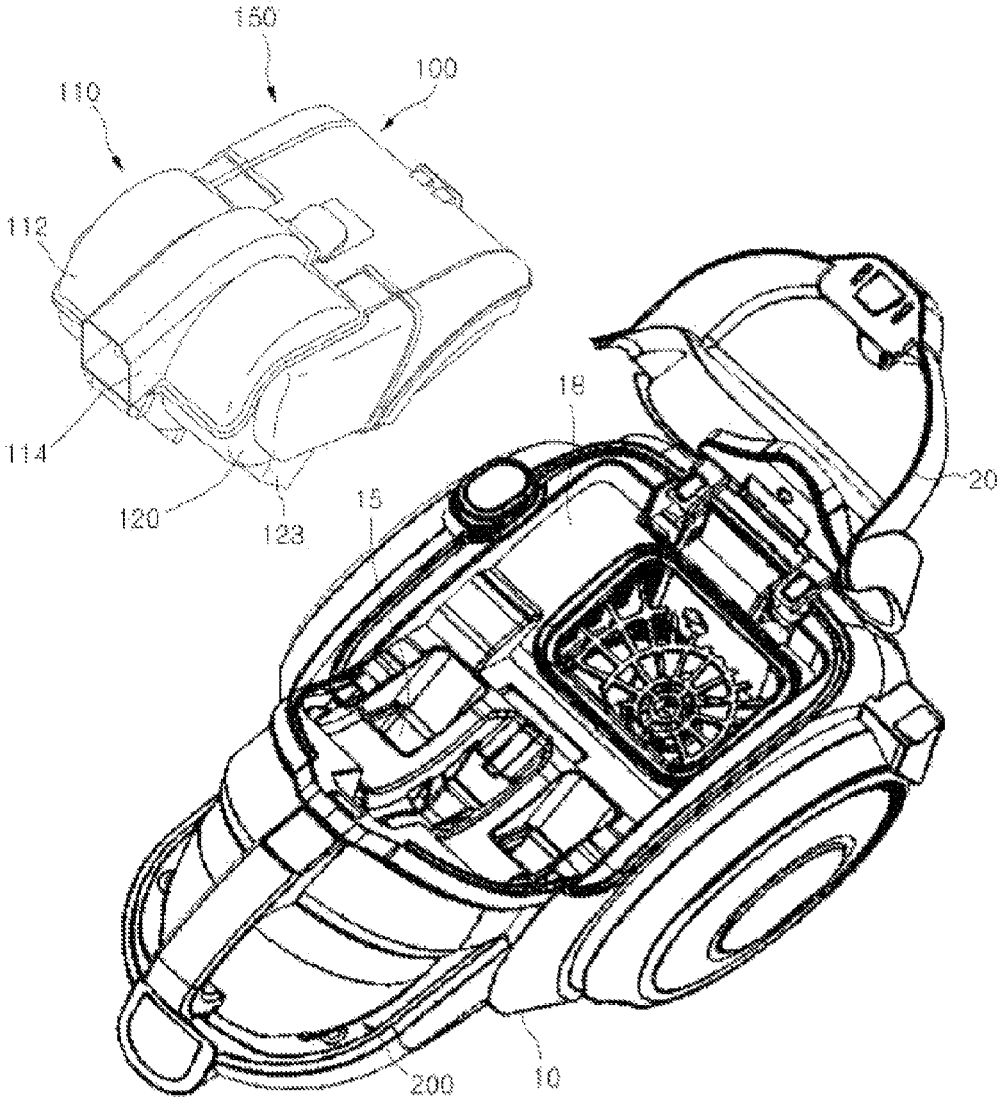
FIG. 3 is a perspective view of the vacuum cleaner from which the dust separation device is separated according to the first embodiment.

FIG. 2 is a perspective view of a vacuum cleaner from which a dust container is separated according to the first embodiment. FIG. 3 is a perspective view of a vacuum cleaner from which a dust separation device is separated according to the first embodiment.

Referring to FIGS. 1 and 3, a vacuum cleaner 1 according to an embodiment includes a cleaner main body 10 including a suction motor (not shown) therein, a dust separation device 100 for separating dusts from air containing the dusts, and a dust container 200 separably disposed on the cleaner main body 10 to store the dusts separated in the dust separation device 100.

In detail, one or more wheels 12 for easily moving the cleaner main body 10 are disposed on the cleaner body 10. A mounting part 13 for mounting a dust container 200 is disposed on the cleaner main body 10. Also, a fixing plate 14 for fixing the dust container 200 is disposed above the mounting part 13.

A receiving part 18 for receiving the dust separation device 100 is disposed above the cleaner main body 10. A cover member 20 for covering the dust separation device 100 in a state where the dust separation device 100 is received in the receiving part 18 is disposed on the cleaner main body 10. The cover member 20 has one end rotatably coupled to a hinge of the cleaner main body 10 and the other end separably coupled to the fixing plate 14. A coupling button 22 for coupling the cover member 20 to the fixing plate 14 is disposed on the cover member 20. Also, an end of the coupling button 22 is selectively hung on the fixing plate 14.

In a state where the dust separation device 100 is received in the receiving part 18, a portion of the dust separation device 100 is seated on the fixing plate 14. An opening 16 for moving the dusts separated by the dust separation device 100 into the dust container 200 is defined in the fixing plate 14. The opening 16 communicates with a dust discharge part (that will be described later) of the dust separation device 100. The dust separation device 100 includes a cyclone unit 110 for separating dusts from air using a cyclone flow and a filter unit 150 coupled to the cyclone unit 110 to filter air discharged from the cyclone unit 110. The cyclone unit 110 includes a first cyclone body 112 and a second cyclone body 120 rotatably coupled to the first cyclone body 112. That is, the first and second cyclone bodies 112 and 120 are coupled to each other to define an outer appearance of the cyclone unit 110.

Also, a plurality of suction parts 123 are disposed in the second cyclone body 120, and a dust discharge part 114 through which the dusts separated from the air are discharged is disposed in the first cyclone body 112. When the dust separation device 100 is received in the receiving part 18, the plurality of suction parts 123 communicate with suction holes 15, respectively.

Figure 4:
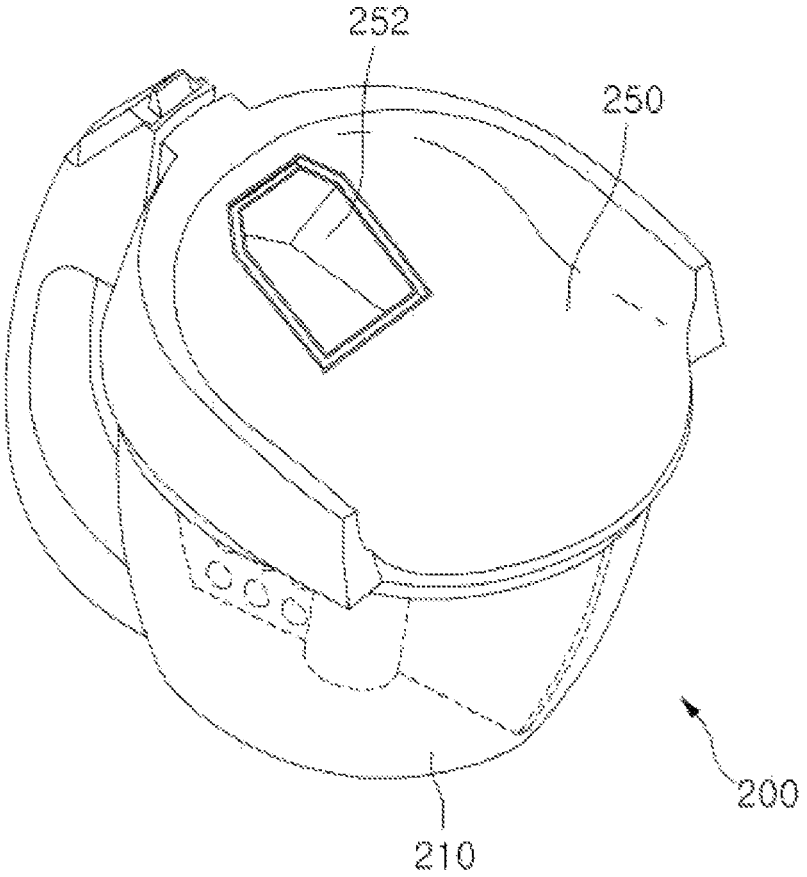
FIG. 4 is a perspective view of the dust container according to the first embodiment.
Figure 5:
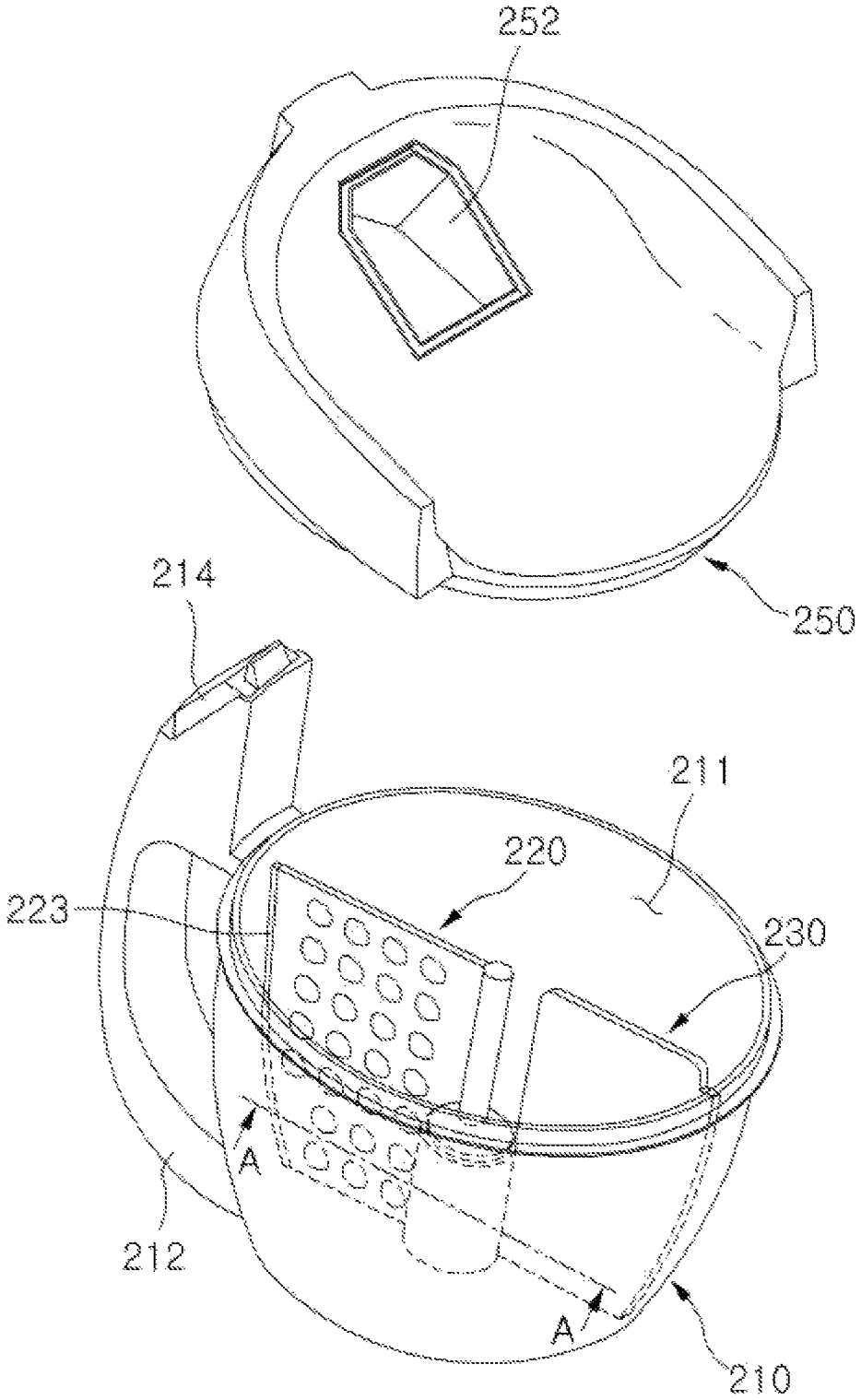
FIG. 5 is an exploded perspective view of the dust container.

FIG. 4 is a perspective view of a dust container according to the first embodiment. FIG. 5 is an exploded perspective view of the dust container.

Referring to FIGS. 4 and 5, the dust container 200 according to the current embodiment includes a dust collection body 210 including a dust storage part 211 and a cover member 250 coupled to an upper portion of the duct collection body 210.

In detail, a handle 212 to be grasped by a user is disposed on the duct collection body 210. Also, a coupling lever 214 selectively coupled to the fixing plate 14 is disposed on an upper portion of the handle 212. A dust inflow part 252 through which the dusts separated in the dust separation device 100 are introduced is disposed in the cover member 250. The front surface of the storing device 252 is open to communicate with the opening 316 of the first door 16.

A plurality of pressing members for pressing the dusts stored in the dust storage part 211 are disposed inside the dust collection body 210. The plurality of pressing members includes a first pressing member 220 rotatably disposed on the dust collection body 210 and a second pressing member 230 integrated with the dust collection body 210.

Figure 6:
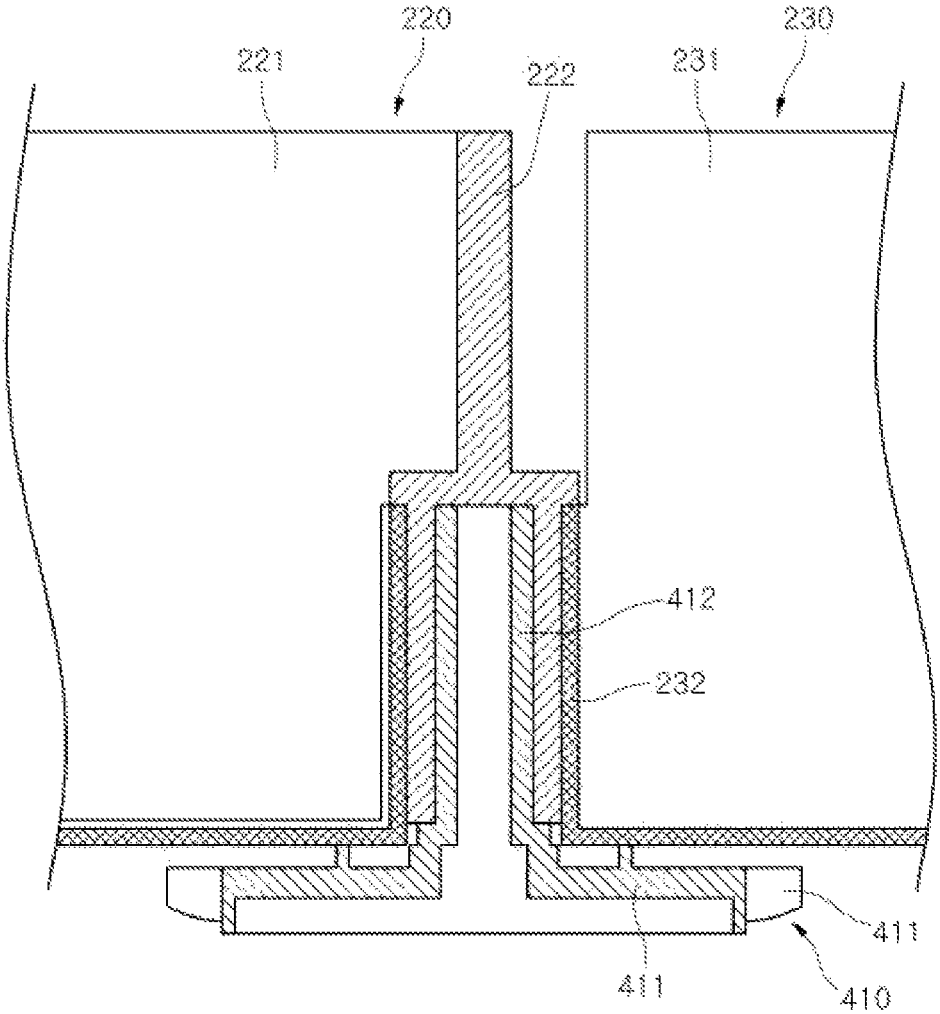
FIG. 6 is a sectional view taken along line A-A' of FIG. 5.
Figure 7:
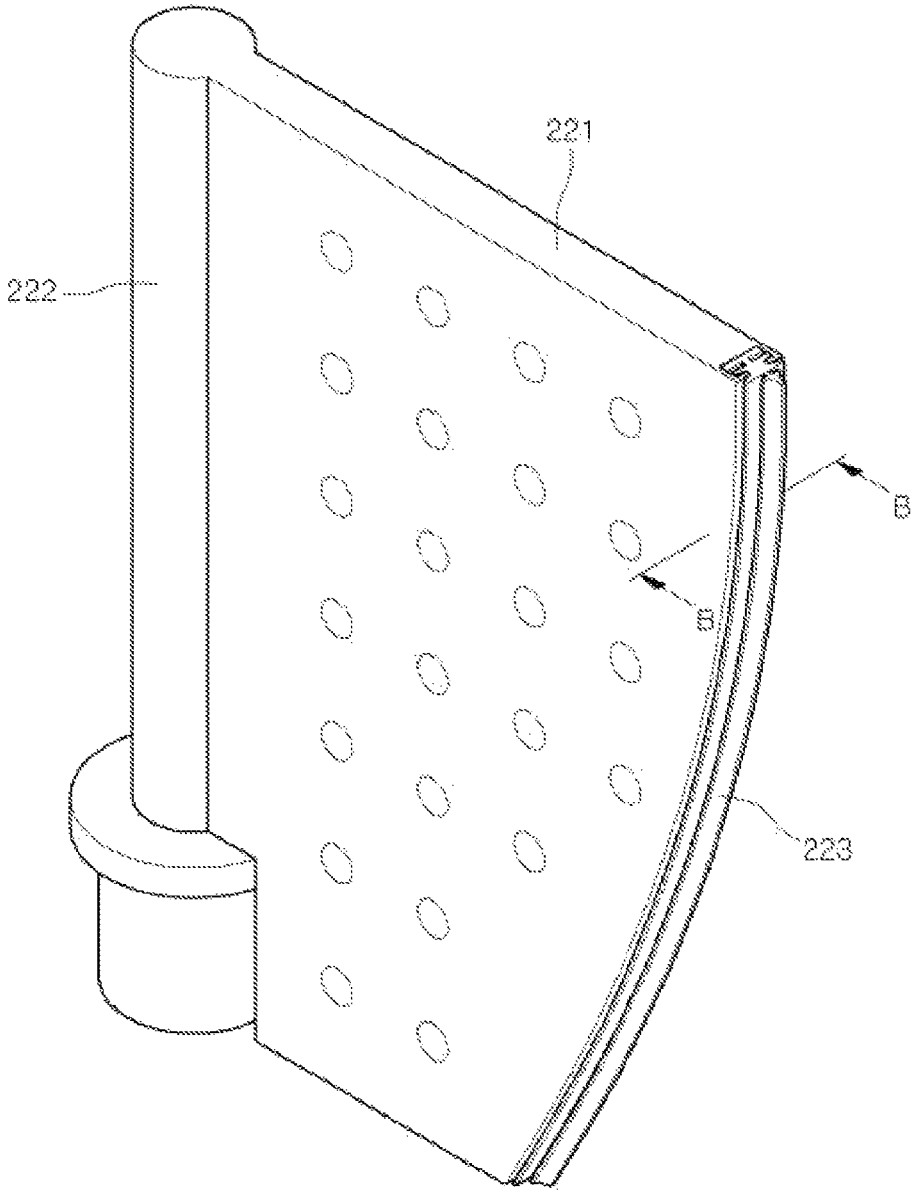
FIG. 7 is a perspective view of a first pressing member.
Figure 8:
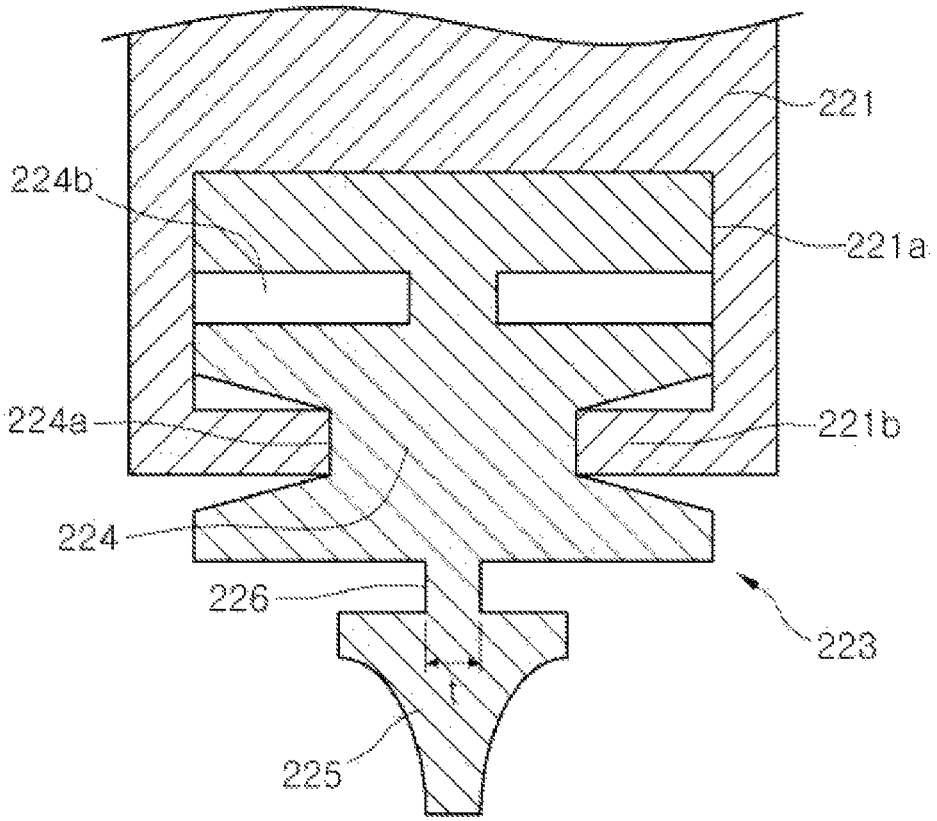
FIG. 8 is a sectional view taken along line B-B' of FIG. 7.

FIG. 6 is a sectional view taken along line A-A' of FIG. 5. FIG. 7 is a perspective view of the first pressing member according to the first embodiment. FIG. 8 is a sectional view taken along line B-B' of FIG. 7.

Referring to FIGS. 5 to 8, the first pressing member 220 includes a first pressing plate 221, a first pressing plate 221 interacting with the second pressing member 230 to press the dusts, a rotation shaft 222 integrated with the first pressing plate 221, and a cleaning member 223 coupled to the first pressing plate 221.

The second pressing member 230 includes a second pressing plate 231 interacting with the first pressing plate 221 to press the dusts and a fixed shaft 232 coupled to the rotation shaft 222. The fixed shaft 232 may be integrated with the duct collection body 210. The fixed shaft 232 may be disposed on a bottom surface of the duct collection body 210. The fixed shaft 232 may protrude upward from the bottom surface of the duct collection body 210. The rotation shaft 222 may be inserted into the fixed shaft 232. Thus, since the fixed shaft 232 guides the rotation of the rotation shaft, the fixed shaft 232 may be called a guide part. The second pressing plate 231 may be integrated with an inner surface of the dust collection body 210 or the bottom surface of the dust collection body 210.

The cleaning member 223 may be disposed between the first pressing plate 221 and an inner surface of the dust collection body 210. For example, FIG. 7 illustrates a structure in which the cleaning member 223 is coupled to a side surface of the first pressing plate 221.

That is, the first pressing plate 221 has one side integrated with the rotation shaft 222 and the other side coupled to the cleaning member 223. Alternatively, one side of the first pressing plate 221 may be coupled to the rotation shaft 222. The cleaning member 223 may be formed of a rubber material having elasticity, but the present disclosure is not limited thereto. The present disclosure is not limited to a material of the cleaning member 223. The cleaning member 223 may be slidably coupled to the side surface of the first pressing plate 221 or integrated with the first pressing plate 221 through insert injection molding. The present disclosure is not limited to the coupling method between the cleaning member 223 and the first pressing plate 221.

A receiving part 221*a* for receiving the cleaning member 223 is disposed in a side end of the first pressing plate 221. A plurality of separation prevention parts 221*b* for preventing the cleaning member 223 received in the receiving part 221*a* from being separated is disposed on the side end of the first pressing plate 221.

The cleaning member 223 includes a body part 224 received in the receiving part 221*a*, a contact part 225 contacting an inner wall of the duct collection body 210, and a connection part 226 connecting the body part 224 to the contact part 225. The body part 224 includes a plurality of insertion parts 224*a* in which the plurality of separation prevention parts 221*b* are inserted respectively and a recessed part 224*b* for easily inserting the body part 224 into the receiving part 221*a*. The cleaning member 223 may be recessed a predetermined depth from the outside toward the inside thereof to form the insertion part 224*a* and the recessed part 224*b*. In case where a pressure is applied to the body part 224 including the recessed part 224*b*, the body part 224 may be easily deformed when compared that the recessed part 224*b* is not provided. Thus, the body part 224 may be easily inserted into the receiving part 221*a*. That is, when a pressure is applied to the body part 224 to couple the body part 224 to the receiving part 221*a*, the body part 224 may be easily deformed by the recessed part 224*b*. As a result, the body part 224 may be easily coupled to the receiving part 221*a*.

Also, when the pressure applied to the body part 224 is removed, an adhesion force between the body part 224 and the receiving part 221*a* may be increased by a force intended to return to an original state of the body part 224. Also, when the body part 224 is received into the receiving part 221*a*, the separation prevention part 221*b* is inserted into the insertion part 224*a*. Thus, it may prevent the body part 224 from being separated laterally from the first pressing plate 221 by the separation prevention part 221*b*. The contact part 225 may have a sectional area gradually decreasing from the connection part 226 toward an inner wall of the dust collection body 210. That is, the contact part 225 may have, for example, a triangular shape, but is not limited thereto.

For easy relative motion between the contact part 225 and the body part 224, the connection part 226 may have a thickness t less than that of each of the body part 224 and the contact part 225. That is, when viewed on the whole of the cleaning member 223, the cleaning member 223 may be easily deformed by the connection part 226.

A distance from a rotation center line of the first pressing member 220 to the contact part 225 is greater than that from the rotation center line of the first pressing member 220 to the duct collection body 210. Thus, when the first pressing member 220 is rotated within the duct collection body 210, the cleaning member 223 may be deformed by the connection part 226. That is, the contact part 225 may be changed in position with respect to the body part 224 by the connection part 226.

Figure 9:
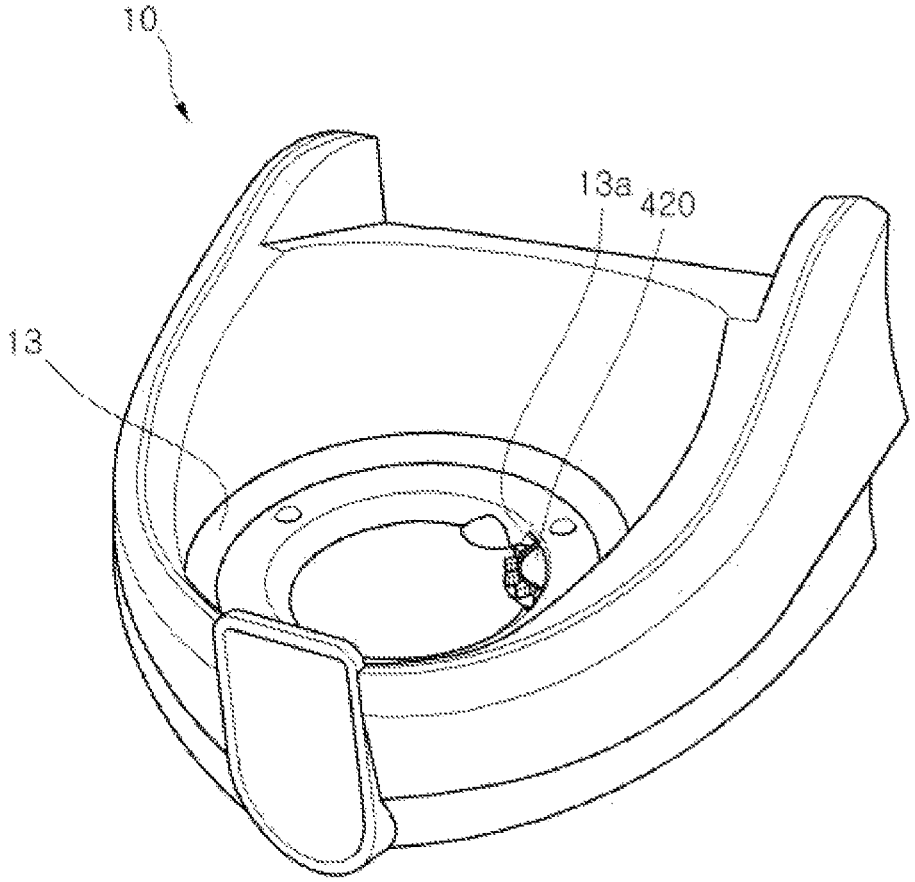
FIG. 9 is a perspective view of a mounting part according to the first embodiment.

FIG. 9 is a perspective view of a mounting part according to the first embodiment.

Referring to FIGS. 6 and 9, the first pressing member 220 may be rotated by a driving device.

In detail, the driving device may include a driving source for generating a driving force and power transmission parts 410 and 420 for transmitting the driving force of the driving source into the first pressing member 220. A compression motor (not shown) may be used as the driving source. The compression motor may be disposed within the main body 10.

The power transmission parts 410 and 420 may include a driven gear 410 coupled to the rotation shaft of the first pressing member 220 and a driving gear 420 transmitting the driving force of the compression motor into the driven gear 410. Here, the driving gear 420 may be referred to as a first gear, and the driven gear 410 may be referred to as a second gear. Also, the driving gear 420 is coupled to the rotation shaft of the compression motor and thus rotated by the compression motor. Thus, when the compression motor is rotated, the driving gear 420 coupled to the compression motor is rotated. Then, the rotation force of the compression motor is transmitted into the driven gear 410 by the driving gear 420 to rotate the driven gear 410. Therefore, the driven gear 410 is rotated to rotate the first pressing member 220.

In detail, the driven gear 410 includes a gear body 411 including a plurality of teeth and a gear shaft 412 vertically extending upward from the gear body 411. The gear shaft 412 of the driven gear 410 is coupled to the rotation shaft 222 of the first pressing member 220 under the duct collection body 210. Thus, the driven gear 410 is exposed to the outside of the duct collection body 210. The compression motor is disposed inside the mounting part 13, and the driven gear 420 is coupled to the shaft of the compression motor and disposed on the bottom surface of the mounting part 13. Also, a portion of an outer surface of the driving gear 420 is exposed to the outside of the bottom surface of the mounting part 13. An opening 13*a* for exposing the portion of the outer surface of the driving gear 420 toward the mounting part 13 is defined in the bottom surface of the mounting part 13. As the driving gear 420 is exposed to the mounting part 13, the driven gear 410 is engaged with the driving gear 420 when the dust container 200 is mounted on the mounting part 13.

Here, a motor that can be rotated in both directions may be used as the compression motor. Thus, the first pressing member 200 may be forwardly or reversely rotated. As the first pressing member 220 is forwardly or reversely rotated, the compressed dusts may be accumulated on both sides of the second pressing member 230.

As described above, a synchronous motor may be used as the compression motor so that the compression motor is forwardly and reversely rotatable. The synchronous motor may be forwardly and reversely rotated by itself. For example, in a case where the motor is rotated in one direction, when a force applied to the motor is above a set value, the motor may be rotated in the other direction.

Hereinafter, an operation of the vacuum cleaner and a process of pressing the dusts will be described.

Figure 10:
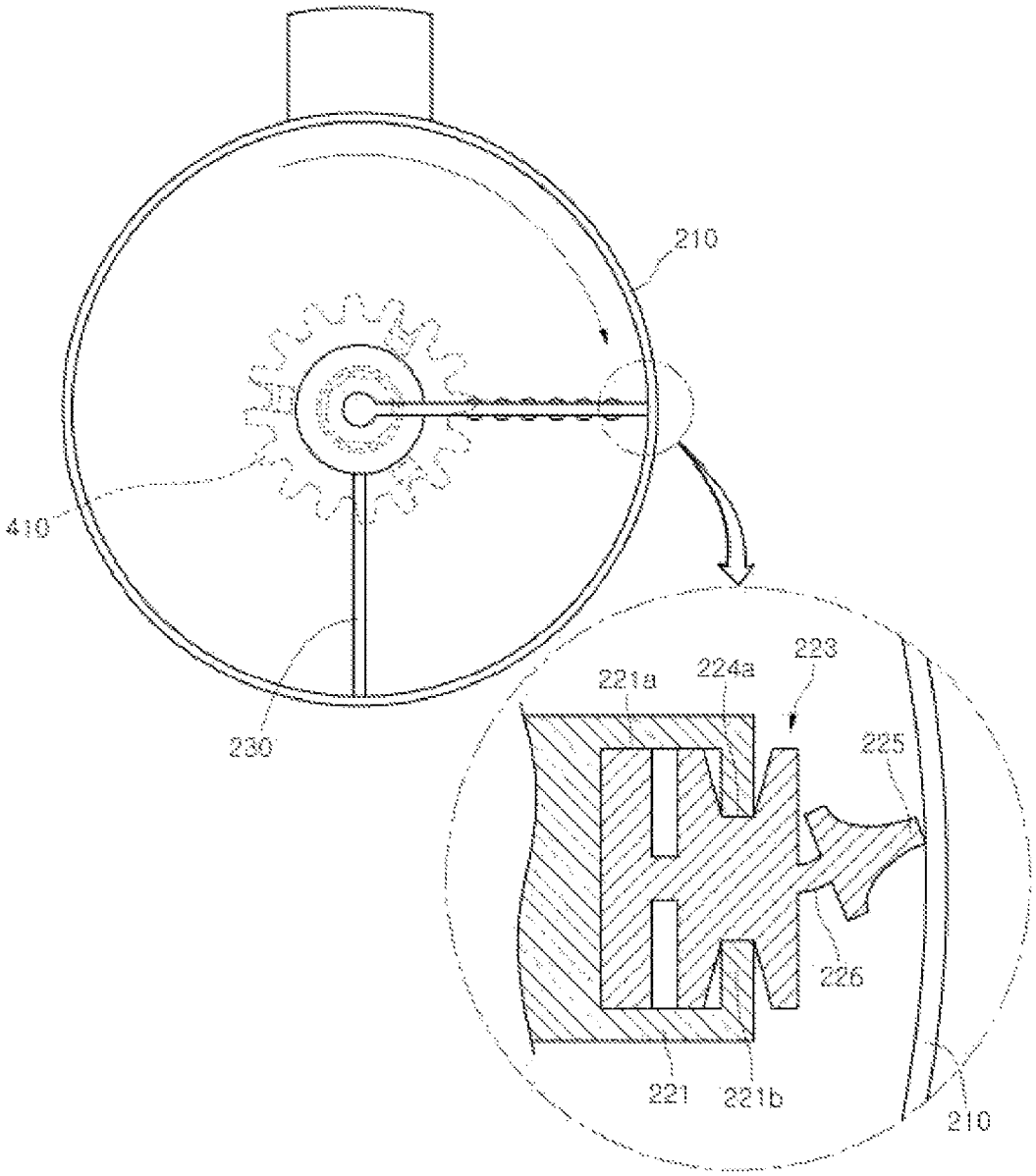
FIG. 10 is a horizontal sectional view of a dust collection body when the first pressing member is rotated in a clockwise direction.

FIG. 10 is a horizontally sectional view of a dust collection body when the first pressing member is rotated in a clockwise direction.

Referring to FIGS. 1 to 10, when the suction motor (not shown) is operated, dusts are sucked through a suction nozzle by a suction force of the suction motor (not shown). Then, the air sucked through the suction nozzle is introduced into the cleaner main body 10. When the suction force is generated by the suction motor disposed inside the cleaner main body 10, the air containing dusts is introduced into the cleaner main body 10. The air introduced into the cleaner main body 10 is distributed into each of the suction parts of the dust separation device 100.

The air introduced into the dust separation device 100 is separated from the dusts while flowing along an inner surface of the cyclone unit 110. Then, the separated dusts are discharged into the dust discharge part 114. The air within the dust discharge part 114 passes through the opening 15 of the fixing plate 14 and is moved into the dust container 200 through the dust inflow part 252.

On the other hand, the air is discharged into the cyclone unit 110 and moved into the filter unit 150. The air moved into the filter unit 150 is filtered and introduced into the cleaner main body 10. The air introduced into the cleaner main body 10 passes through the suction motor and then is discharged to the outside of the cleaner main body 10.

As described above, when the dusts contained in the air are separated and stored in the dust storage part 211, the plurality of pressing members 220 and 230 compress the dusts stored in the dust storage part 211 through the interaction therebetween. That is, a control unit (not shown) may operate the compression motor (not shown) to compress the dusts stored in the dust container 200.

When the compression motor (not shown) is operated, the driving gear 420 is rotated. When the driving gear 420 is rotated, the driven gear 410 engaged with the driving gear 420 is rotated. When the driven gear 410 is rotated, the first pressing member 220 coupled to the driven gear 410 is rotated toward the second pressing member 230 to compress the dusts.

When the first pressing member 220 is rotated within the duct collection body 210, the cleaning member 223 is rotated together with the first pressing plate 221. Here, the contact part 225 is changed in position by the connection part 226 to maintain the contact with the inner surface of the duct collection body 210. Since the contact part 225 is rotated in a state where the contact part 225 contacts the inner surface of the duct collection body 210, dusts or sands attached to the inner surface of the duct collection body 210 may be removed.

Also, since a gap between the first pressing plate 221 and the inner wall of the dust collection body 210 is removed by the cleaning member 223, it may prevent the sands or foreign materials from being disposed between the first pressing plate 221 and the dust collection body 210 to remove noise generated by friction between the sands or foreign materials and the duct collection body 210.

For example, when the first pressing plate 221 is rotated in the clockwise direction as shown in FIG. 10, a force in the counter clockwise direction may be applied to the contact part 225. Thus, the connection part 226 of the cleaning member 223 may be bent in the counter clockwise direction.

Since the connection part 226 of the cleaning member 223 is a thin thickness, the bending direction of the connection may be easily changed according to the change of the rotation direction of the pressing plate 221. Thus, when compared that the connection part 226 has a thick thickness or is not provided, a life cycle of the cleaning member 223 may be improved.

Although the plurality of pressing members are provided in the current embodiment, the present disclosure is not limited thereto. For example, one pressing member may be provided to compress the dusts.

Also, the compression member may be vertically translated to compress the dusts or forwardly and backwardly translated to compress the dusts.

Also, although the pressing member is automatically rotated by the driving source, the present disclosure is not limited thereto. For example, the pressing member may be automatically translated by the driving source. Also, the pressing member may be manually rotated or translated.

In the current embodiment, the compressing member is not limited to its moving method or number. However, the technical significance lies in the fact that the cleaning member for cleaning the inner wall of the duct collection body.

Figure 11:
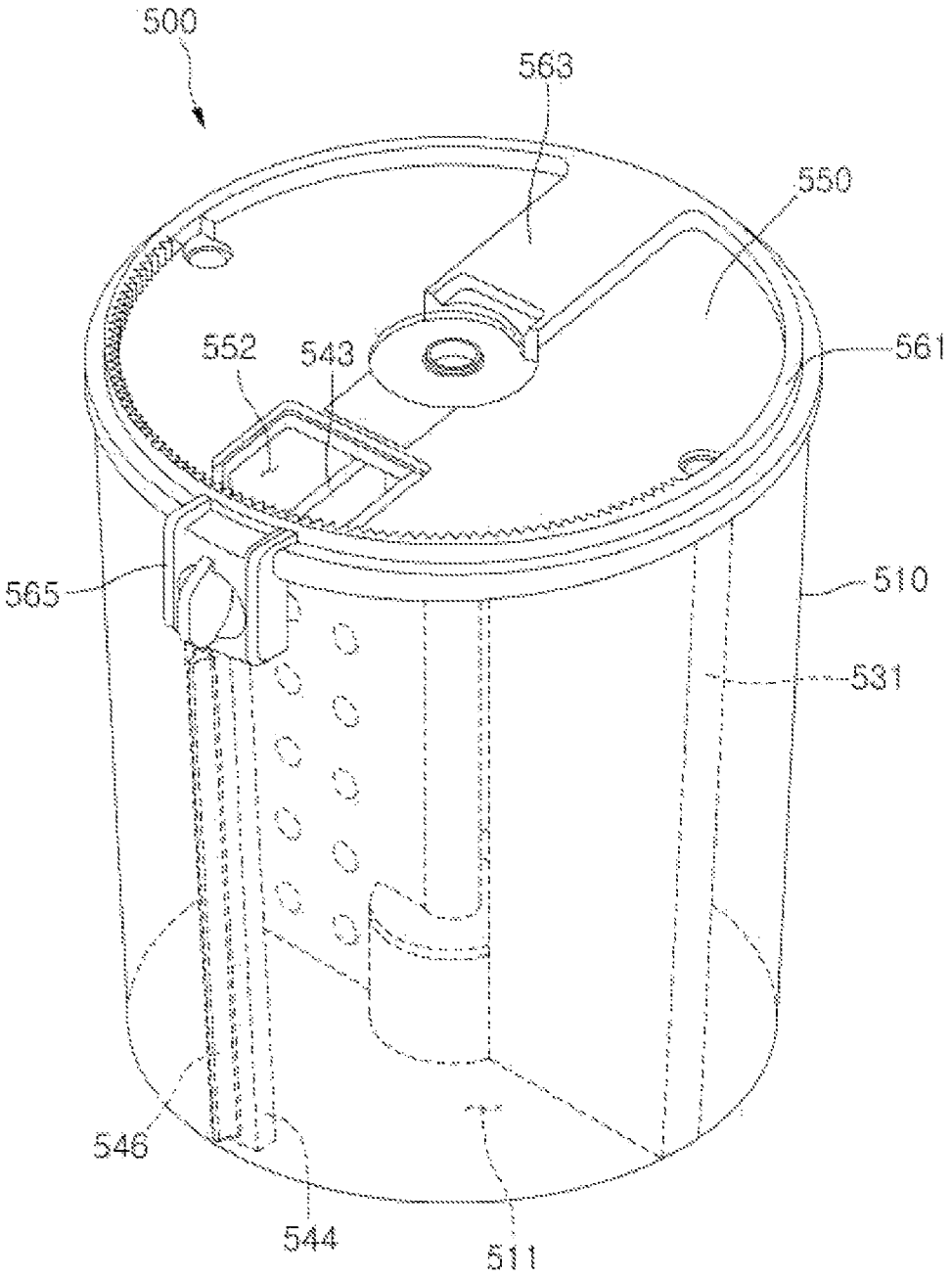
FIG. 11 is a perspective view of a dust container according to the second embodiment.
Figure 12:
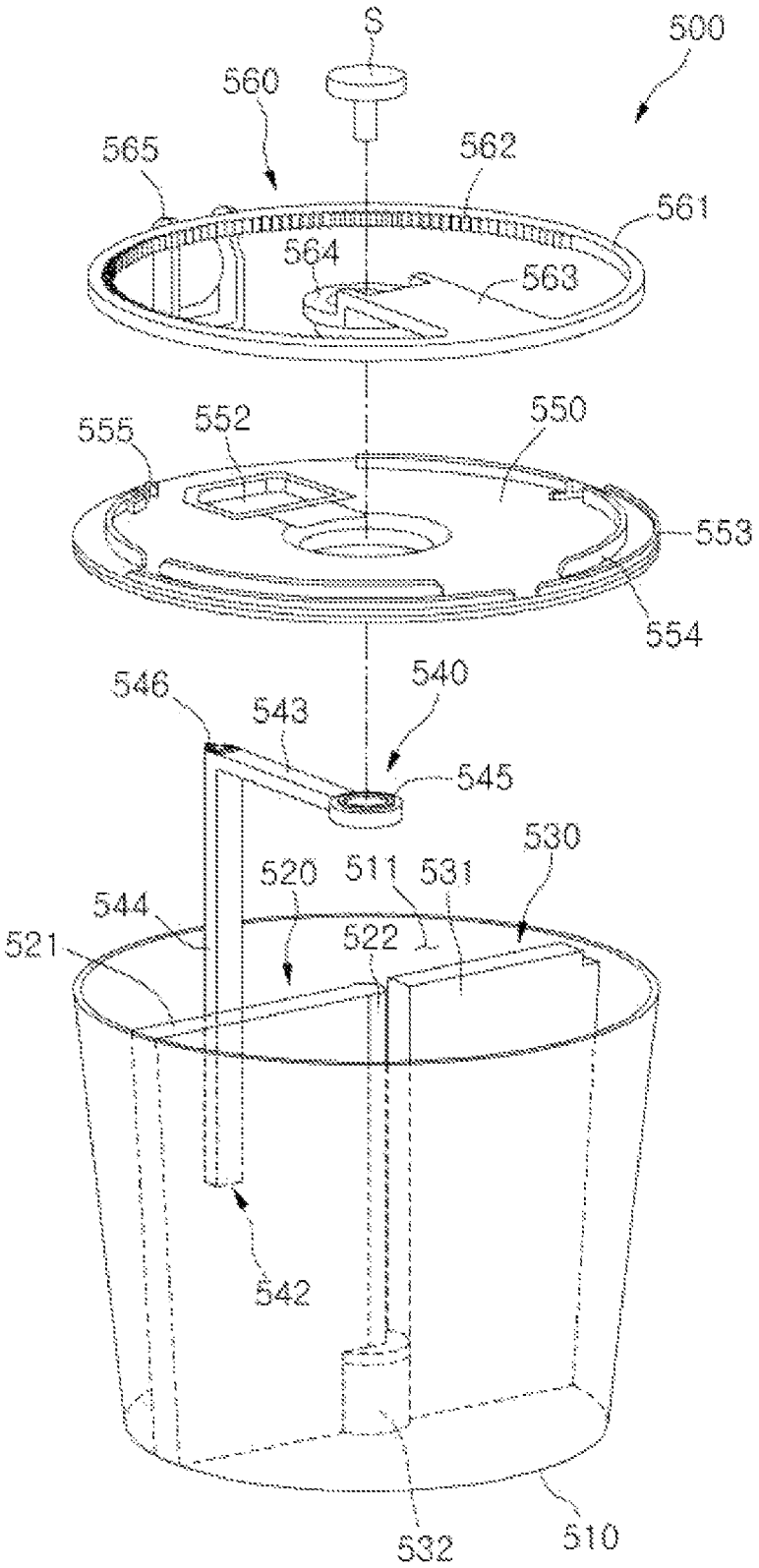
FIG. 12 is an exploded perspective view of the dust container according to the second embodiment.

FIG. 11 is a perspective view of a dust container according to the second embodiment. FIG. 12 is an exploded perspective view of the dust container according to the second embodiment.

The current embodiment is the same as the first embodiment except for a position and structure of a cleaning member. Hereinafter, only the features of the current embodiment will be described, and thus, descriptions of the same configuration as those of the first embodiment will be quoted from the first embodiment.

Referring to FIGS. 11 and 12, a dust container 500 according to the current embodiment includes a dust collection body 510 defining a dust storage part 511, a cover member 550 coupled to an upper portion of the duct collection body 510, a cleaning unit 540 for cleaning an inner wall of the dust collection body 510, a driving unit 560 disposed on a top surface of the cover member 550 to drive the cleaning unit 540, and a plurality of pressing members for compressing dusts stored in the duct collection body 510.

In detail, the plurality of pressing members include a first pressing member 520 rotatably disposed on the duct collection body 510 and a second pressing member 530 integrated with the duct collection body 510. The first pressing member 520 includes a first pressing plate 521 and a rotation shaft 522 connected to the first pressing plate 521. The second pressing member 530 includes a second pressing plate 531 and a fixed shaft 532 coupled to the rotation shaft 522.

The first pressing member may be automatically rotated by the driving device described in the first embodiment. Here, the first pressing member is rotated independent from the driving unit.

The cover member 550 includes a dust inflow part 552 through which dusts are introduced into the dust collection body 510. A plurality of guide parts for guiding the movement of the driving unit 560 are disposed on a top surface of the cover member 550. The plurality of guide parts include an outer guide part 553 and an inner guide part 554 spaced from the outer guide part 553. Also, the driving unit 560 may be movable between the outer guide part 553 and the inner guide part 554.

The driving unit 560 includes a body disposed on the top surface of the cover member 550 and a manipulation part 565 disposed on the body 561 and manipulated by a user. The body 561 has a ring shape, and the manipulation part 565 is disposed on an outer surface of the body 561. An extension part 563 extending in a center direction of the body 561 is disposed on an inner surface of the body 561. A connection part 564 connected to the cleaning unit 540 is disposed on the extension part 563.

The cleaning unit 540 is connected to the connection part 564 under the cover member 550. Also, when the cover member 550 is coupled to the duct collection body 510, the cleaning unit 540 is received into the duct collection body 510. The cleaning unit 540 includes a cleaning member 546 for cleaning the inner surface of the duct collection body 510 and a support part 542 supporting the cleaning member 546. The support part 542 includes a horizontal part 543 extending in a horizontal direction and a vertical part 544 vertically extending from an end of the horizontal part 543. A coupling part 545 connected to the connection part 564 is disposed on the horizontal part 543. The coupling part 545 is inserted into the connection part 564. Also, the connection part 564 and the coupling part 545 may be coupled to each other by a coupling member S. The cleaning member 546 may be coupled to the vertical part 544. For example, the cleaning member 546 may be coupled to the vertical part 544 through a sliding method or integrated with the vertical part 544 through an insert injection molding method. Since the cleaning member 546 has the same structure as that of the first embodiment, its detailed description will be omitted.

When the cover member 550 is coupled to the dust collection body 510, the horizontal part 543 is disposed above the rotation shaft 522. The vertical part 544 is disposed between the inner surface of the duct collection body 510 and the first pressing plate 521. A side end of the cleaning member 546 is closely attached to the inner surface of the dust collection body 510. Thus, when the manipulation part 565 is moved in one or the other direction, the cleaning unit 540 connected to the connection part 564 is rotated to clean an inner wall of the dust collection body 510 by the cleaning member 546. Here, to smoothly rotate the cleaning unit 540, a distance from a center of the rotation shaft 522 to the vertical part 544 may be greater than that from the center of the rotation shaft 522 to the side end of the first pressing plate 521.

A plurality of projections 562 are disposed on an inner surface of the body 561. The plurality of projections 562 are spaced from each other in a horizontal direction. Also, a fixing part 555 for fixing the driving unit 560 is disposed on the inner guide part 554. The fixing part 555 is elastically moved. Also, when the driving unit 560 is rotated, the fixing part 555 is rotated by a friction with the plurality of projections 562. A portion of the fixing part 555 is disposed between the pair of projections. In this case, the stopped state of the driving unit 560 may be stably maintained.

Figure 13:
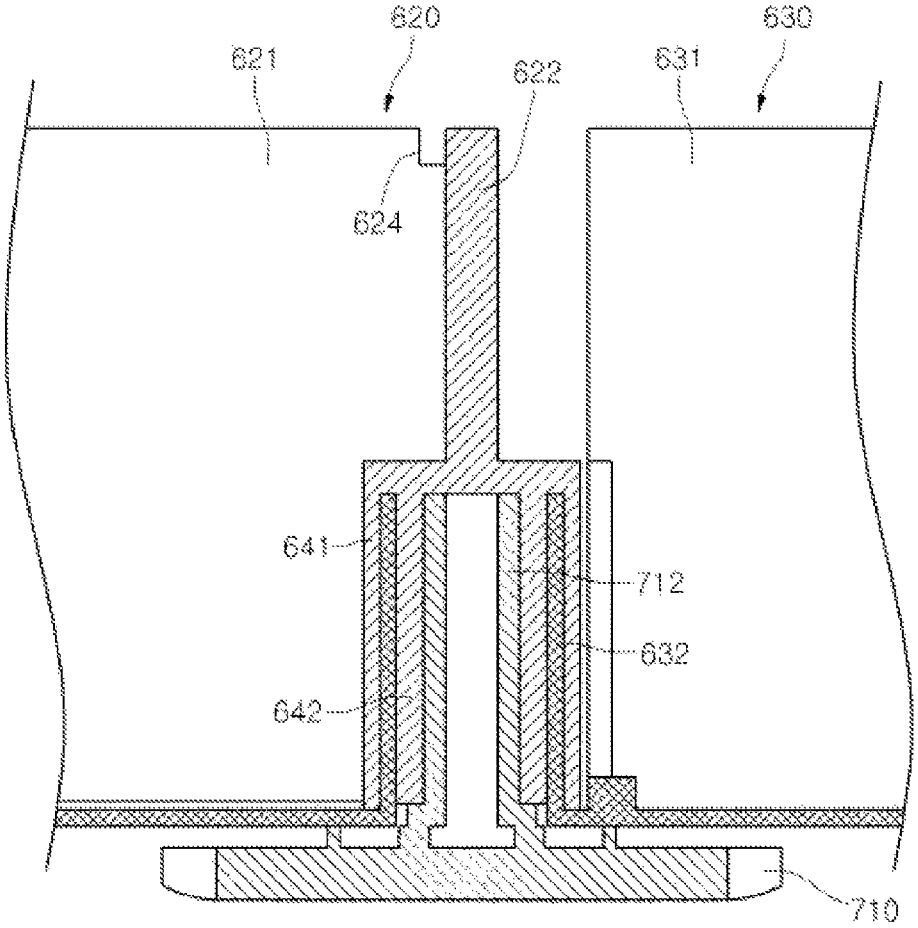
FIG. 13 is a sectional view taken along line A-A' of FIG. 5 according to a third embodiment.
Figure 14:
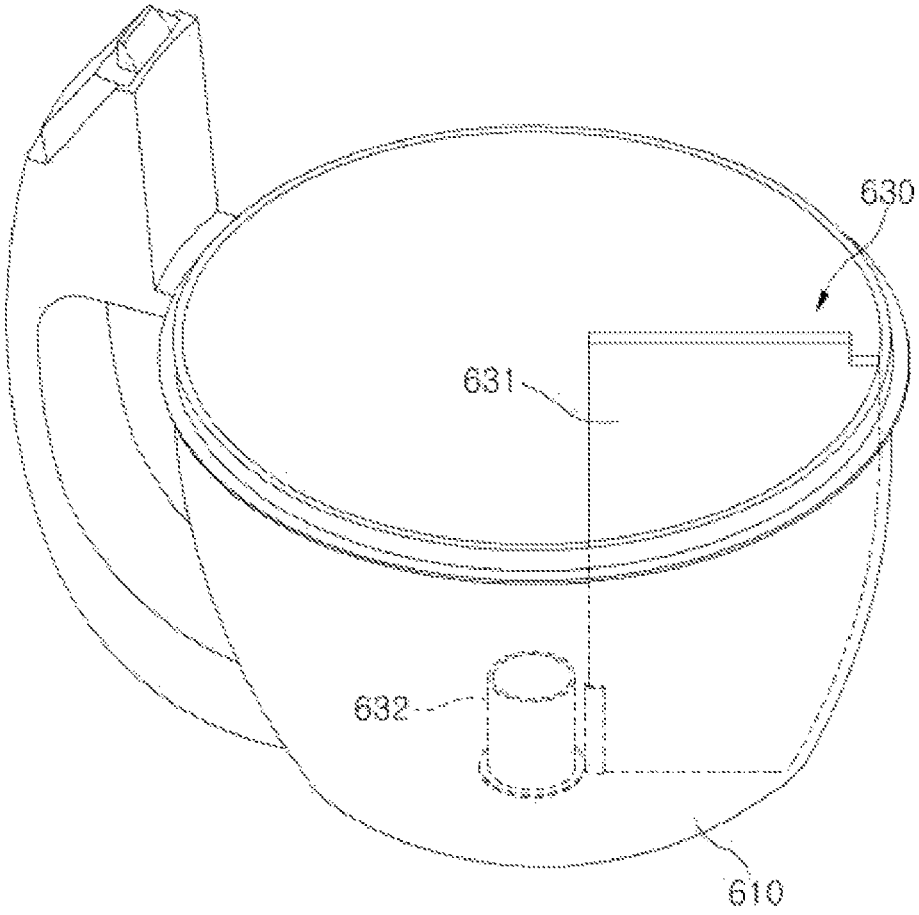
FIG. 14 is a perspective view of a dust collection body in which a first pressing member is separated according to the third embodiment.
Figure 15:
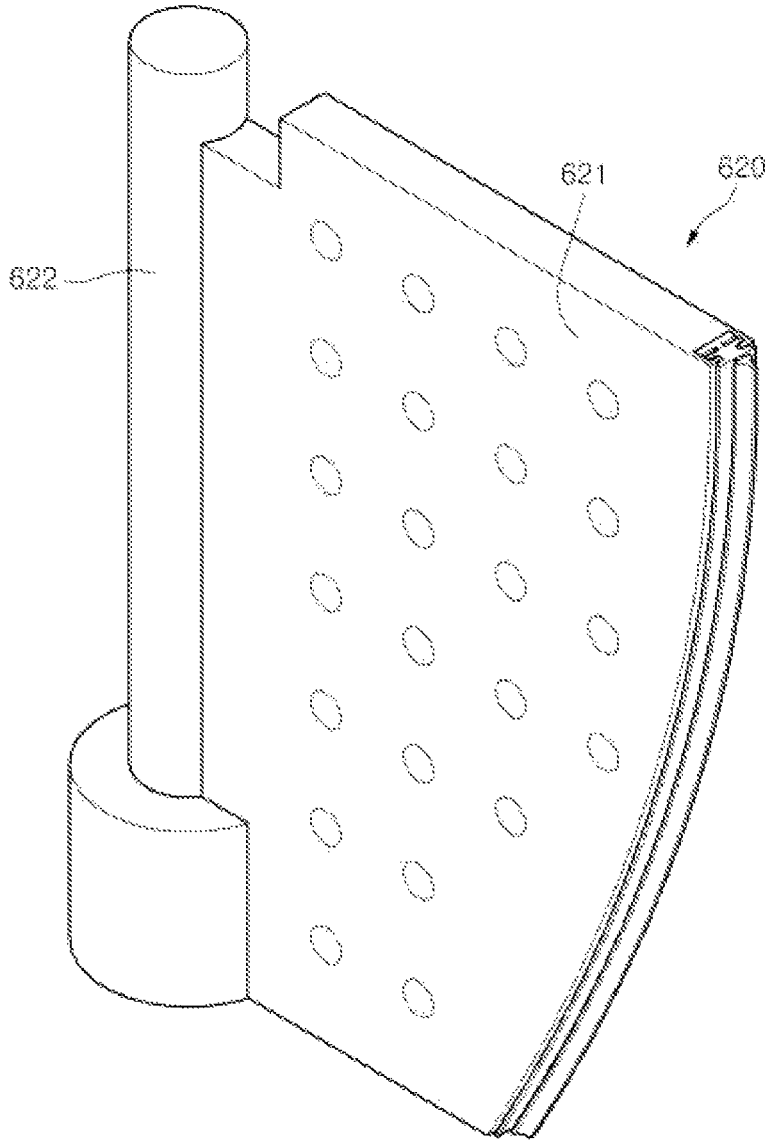
FIG. 15 is a perspective view of the first pressing member according to the third embodiment.

FIG. 13 is a sectional view taken along line A-A' of FIG. 5 according to a third embodiment. FIG. 14 is a perspective view of a dust collection body in which a first pressing member is separated according to the third embodiment. FIG. 15 is a perspective view of the first pressing member according to the third embodiment.

The current embodiment is the same as the first embodiment except for a structure of a pressing member. Hereinafter, only the features of the current embodiment will be described, and thus, descriptions of the same configuration as those of the first embodiment will be quoted from the first embodiment.

Referring to FIGS. 13 to 15, a dust collection body 610 according to the current embodiment includes a plurality of pressing members. The plurality of pressing members include a first pressing member rotatably disposed on the duct collection body 610 and a second pressing member 630 integrated with the dust collection body 610.

The first pressing member 620 includes a first pressing plate 621 for pressing dusts by an interaction with the second pressing member 630 and a rotation shaft 622 integrated with the first pressing plate 621. The second pressing member 630 includes a second pressing plate 631 integrated with the duct collection body 610. The second pressing plate 631 may be integrated with an inner surface of the dust collection body 610 or a bottom surface of the dust collection body 610. Also, a fixed shaft 632 coupled to the rotation shaft 622 protrudes from the bottom surface of the duct collection body 610. The second pressing plate 631 is spaced from the fixed shaft 632. In detail, the rotation shaft 622 includes an outer wall 641 surrounding an outer circumference of the fixed shaft 632 and an inner wall 642 inserted into the fixed shaft 632. The inner wall 642 is rotated in a state where the inner wall 642 is inserted into the fixed shaft 632. Since the fixed shaft guides the rotation of the rotation shaft, the fixed shaft may be referred to as a guide part. The outer wall 641 may remove a gap between the fixed shaft 632 and the first pressing plate 621. Thus, it may prevent foreign materials such as a hair from being hung between the fixed shaft 632 and the first pressing plate 621 and also from being wound around the fixed shaft 632. Thus, the inconvenience in which the foreign materials such as the hair wound around the fixed shaft 632 should be removed may be removed.

Also, the outer wall 641 is disposed between the fixed shaft 632 and the second pressing plate 631.

The first pressing member 620 may be rotated by the driving device, like the first embodiment. A shaft of a driven gear 710 constituting the driving device is inserted into the inner wall 642.

Figure 16:
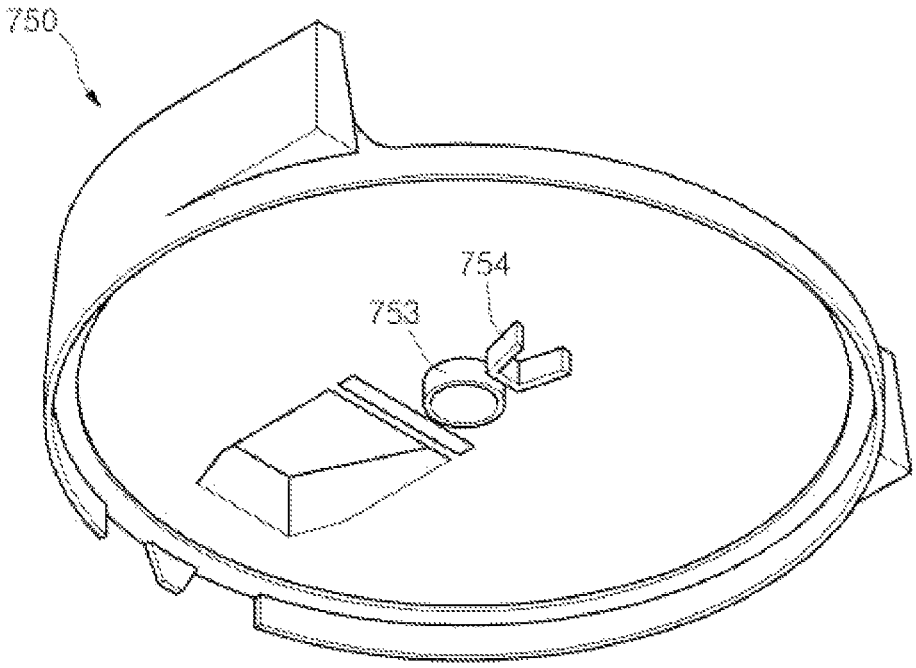
FIG. 16 is a bottom perspective view of a cover member according to the third embodiment.

FIG. 16 is a bottom perspective view of a cover member according to the third embodiment.

Referring to FIGS. 13 and 16, a cover member 750 according to the current embodiment includes a rotation guide 753 for guiding the rotation of the rotation shaft 622 and a support part 754 for preventing the second pressing plate 631 from being deformed when the dusts are compressed by the interaction between the first pressing plate 621 and the second pressing plate 631.

In detail, the rotation guide 753 protrudes downward from a bottom surface of the cover member 750. Also, an upper end of the rotation shaft 622 is inserted into the rotation guide 753. The support part 754 protrudes downward from the bottom surface of the cover member 750 to cover a portion of both upper ends of the second pressing plate 631 in a state where the cover member 750 is coupled to the dust collection body 610. Thus, when the first pressing plate 621 is rotated to compress dusts between the first pressing plate 621 and the second pressing plate 631, it may prevent the second pressing plate 631 from being deformed or damaged because the second pressing plate 631 is supported by the support part 754 even though an external force is applied to the second pressing plate 631.

Referring to FIG. 13, a cutout part 624 for preventing the cover member 750 from interfering is disposed on an upper portion of the first pressing plate 621. Thus, the rotation shaft 622 may be inserted into the rotation guide 753, and the rotation of the rotation shaft 622 may be guided by the rotation guide 753.

What is claimed is:

1. A vacuum cleaner comprising:

a main body; and a dust container communicated with the cleaner main body, the dust container storing dust separated from air, wherein the dust container comprises:

a dust collection body, including a dust storage part to store the dust;

a fixed shaft that protrudes from the dust collection body;

a pressing device, including a rotation shaft in which the fixed shaft is inserted, and a compression plate to compress the dust stored in the dust collection body, wherein the rotation shaft of the pressing device comprises an outer wall that surrounds an outer circumference of the fixed shaft and an inner wall inserted into the fixed shaft.

2. The vacuum cleaner according to claim 1, further comprising a driving device including at least one gear, wherein a gear shaft of the at least one gear is inserted in the inner wall of the rotation shaft.

3. The vacuum cleaner according to claim 1, further comprising a cleaning device contacting an inner surface of the dust collection body to clean the inner surface of the dust collection body.

4. The vacuum cleaner according to claim 3, wherein the cleaning member is rotated together with the compression plate when the compression plate is rotated.

5. The vacuum cleaner according to claim 4, wherein the cleaning member is disposed on the compression plate.

6. The vacuum cleaner according to claim 1, further comprising a cover member to cover the dust collection body, wherein the cover member includes a rotation guide to guide a rotation of the rotation shaft.

7. The vacuum cleaner according to claim 6, wherein the rotation guide protrudes downward from a bottom surface of the cover member.

8. The vacuum cleaner according to claim 6, further comprising a fixed plate fixed to the dust collection body, wherein the cover member further includes a support part to prevent the fixed plate from being deformed when the dust is compressed by the interaction between the compression plate and the fixed plate.

9. The vacuum cleaner according to claim 8, wherein the support part protrudes downward from a bottom surface of the cover member to cover a portion of upper end of the fixed plate in a state where the cover member is coupled to the dust collection body.

* * * * *